US011561505B2

(12) United States Patent
Ishii et al.

(10) Patent No.: US 11,561,505 B2
(45) Date of Patent: Jan. 24, 2023

(54) IMAGE FORMING APPARATUS WITH AN ATTRACTION MEMBER THAT REMOVES FINES PARTICLES

(71) Applicant: FUJIFILM Business Innovation Corp., Tokyo (JP)

(72) Inventors: Kazunari Ishii, Kanagawa (JP); Akio Shimonaga, Kanagawa (JP); Tetsuya Kawatani, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 135 days.

(21) Appl. No.: 16/516,653

(22) Filed: Jul. 19, 2019

(65) Prior Publication Data

US 2020/0292968 A1 Sep. 17, 2020

(30) Foreign Application Priority Data

Mar. 14, 2019 (JP) ..... JP2019-046781

(51) Int. Cl.

| | |
|---|---|
| ***G03G 21/20*** | (2006.01) |
| ***G03G 15/00*** | (2006.01) |
| ***G03G 21/10*** | (2006.01) |

(52) U.S. Cl.

CPC ..... *G03G 21/206* (2013.01); *G03G 15/657* (2013.01); *G03G 21/10* (2013.01); *G03G 2215/00607* (2013.01)

(58) Field of Classification Search

CPC .... G03G 15/161; G03G 15/657; G03G 21/10; G03G 21/206; G03G 2215/00607; G03G 2221/0005

See application file for complete search history.

(56) References Cited

U.S. PATENT DOCUMENTS

| | | | | |
|---|---|---|---|---|
| 5,028,959 | A * | 7/1991 | Gooray | G03G 21/00 399/93 |
| 5,467,180 | A * | 11/1995 | Malachowski | B65H 29/242 271/197 |
| 8,634,751 | B2 * | 1/2014 | Moteki | G03G 15/657 399/322 |
| 9,746,803 | B2 * | 8/2017 | Yabuki | G03G 15/2028 |
| 2020/0201239 | A1 * | 6/2020 | Kawasumi | G03G 21/0052 |

FOREIGN PATENT DOCUMENTS

| | | |
|---|---|---|
| JP | 2017-120284 A | 7/2017 |
| JP | 2017-125976 A | 7/2017 |

* cited by examiner

*Primary Examiner* — Justin N Olamit

(74) *Attorney, Agent, or Firm* — Sughure Mion, PLLC

(57) ABSTRACT

An image forming apparatus includes a transfer member, a fixing member, a guide member, and an attraction member. The transfer member transfers a developer to a medium. The fixing member fixes onto the medium the developer transferred to the medium. The guide member is disposed between the transfer member and the fixing member to guide the medium. The attraction member attracts the developer through the opening. An opening is located upstream of the guide member in a medium transport direction.

4 Claims, 8 Drawing Sheets

IMAGE FORMING APPARATUS WITH AN ATTRACTION MEMBER THAT REMOVES FINES PARTICLES

CROSS-REFERENCE TO RELATED APPLICATIONS

This application is based on and claims priority under 35 USC 119 from Japanese Patent Application No. 2019-046781 filed Mar. 14, 2019.

BACKGROUND

(i) Technical Field

The present disclosure relates to an image forming apparatus.

(ii) Related Art

U.S. Pat. No. 9,746,803 (FIG. 2), Japanese Patent Application Publication No. 2017-120284 (FIG. 1), and Japanese Patent Application Publication No. 2017-125976 (FIG. 4 and FIG. 5) describe technologies for removing minute particles caused when an image forming apparatus such as a copying machine, a printer, or a FAX machine fixes a developer transferred to a medium onto the medium.

U.S. Pat. No. 9,746,803 describes a technology of attracting air with a fan (41) disposed adjacent to and upstream of a fixing device in a medium transport direction to capture minute particles in the air with a filter (43) before discharging the air.

Japanese Patent Application Publication No. 2017-120284 describes a technology of feeding air with a fan (62) disposed downstream of a fixing device in a medium transport direction, and attracting air with a fan (61) disposed upstream of the fixing device to recover minute particles resulting from a lubricant in the developer.

Japanese Patent Application Publication No. 2017-125976 describes a technology of attracting air with a fan (61) disposed upstream of a fixing device in a medium transport direction to recover minute particles resulting from wax (lubricant) contained in a developer.

SUMMARY

Aspects of non-limiting embodiments of the present disclosure relate to reduction of an amount of a floating developer near a transfer area for cleanliness improvement inside an apparatus with a developer discharging system that is disposed between the transfer area and a fixing area, compared to a structure that does not include the system.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus that includes a transfer member that transfers a developer to a medium, a fixing member that fixes to the medium the developer transferred to the medium, a guide member that is disposed between the transfer member and the fixing member to guide the medium, and an attraction member that attracts the developer through the opening. An opening is located upstream of the guide member in a medium transport direction.

BRIEF DESCRIPTION OF THE DRAWINGS

Exemplary embodiments of the present disclosure will be described in detail based on the following figures, wherein.

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are appropriately omitted for ease of understanding.

Example 1

Figure 1:
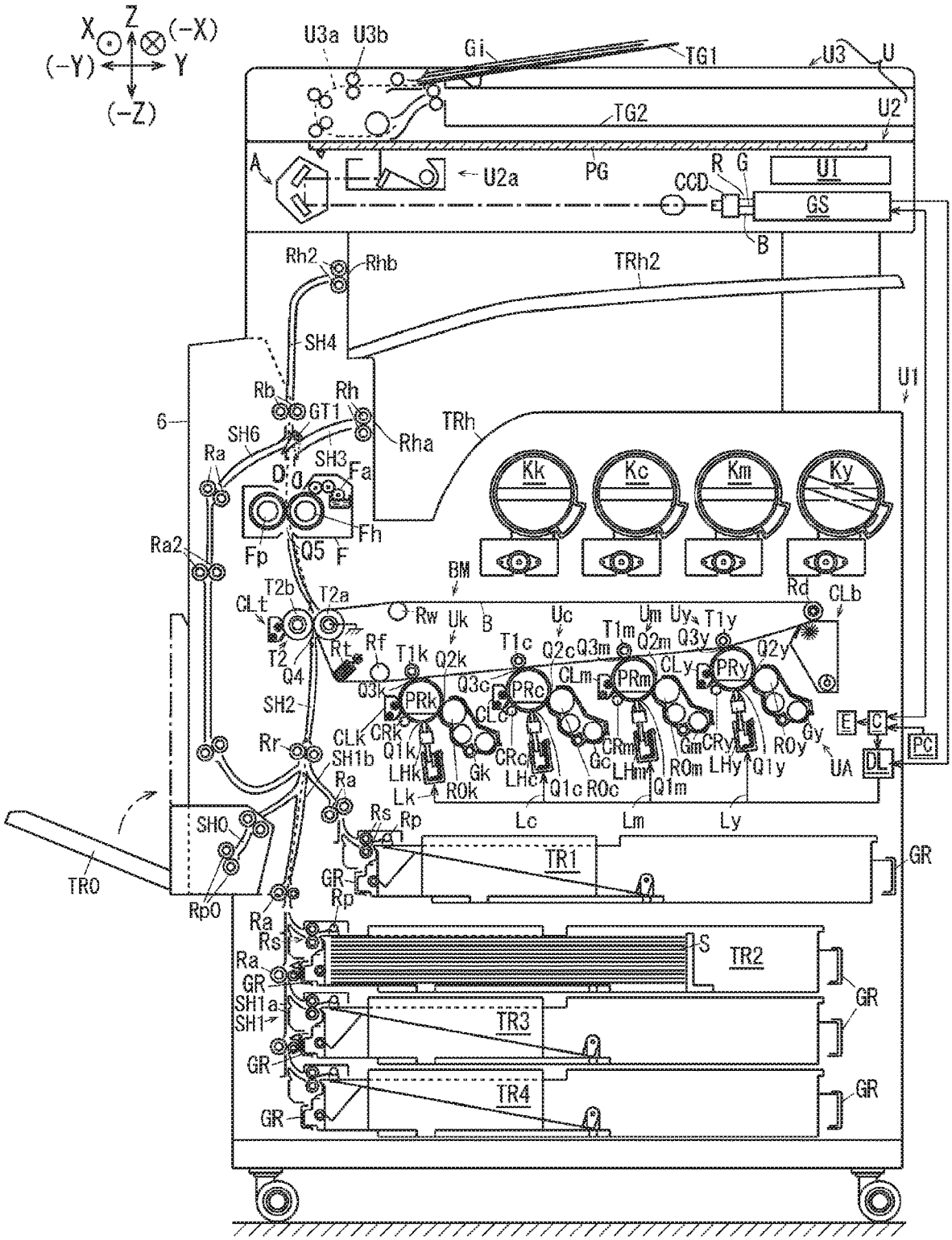
FIG. 1 illustrates the entirety of an image forming apparatus according to an example 1.

FIG. 1 illustrates the entirety of an image forming apparatus according to an example 1.

In FIG. 1, a copying machine U, which is an example of an image forming apparatus according to the example 1 of the present disclosure, includes a printer unit U1, which is an example of a recording unit and an example of an image recording device. The printer unit U1 supports, on its upper side, a scanner unit U2, which is an example of a reading unit and an example of an image reading device. The scanner unit U2 supports, on its upper side, an auto-feeder U3, which is an example of a document transporting device.

The auto-feeder U3 includes, at an upper portion, a document tray TG1, which is an example of a medium accommodating member. The document tray TG1 is capable of accommodating a stack of multiple documents Gi that are to be copied. A document output tray TG2, which is an example of a document discharge portion, is disposed below the document tray TG1. Document transport rollers U3*b* are arranged along a document transport path U3*a* connecting the document tray TG1 to the document output tray TG2.

On the upper surface of the scanner unit U2, a platen glass PG, which is an example of a transparent document table, is disposed. The scanner unit U2 according to the example 1 includes a reading unit U2*a*, which is an example of the reading unit, under the platen glass PG. The reading unit U2*a* according to the example 1 is supported to be movable in the lateral direction, which is an example of a sub-scanning direction, along the lower surface of the platen glass PG. The reading unit U2*a* is stationary in a normal state in an initial position drawn with a solid line in FIG. 1. The reading unit U2*a* is electrically connected to an image processor GS.

Figure 2:
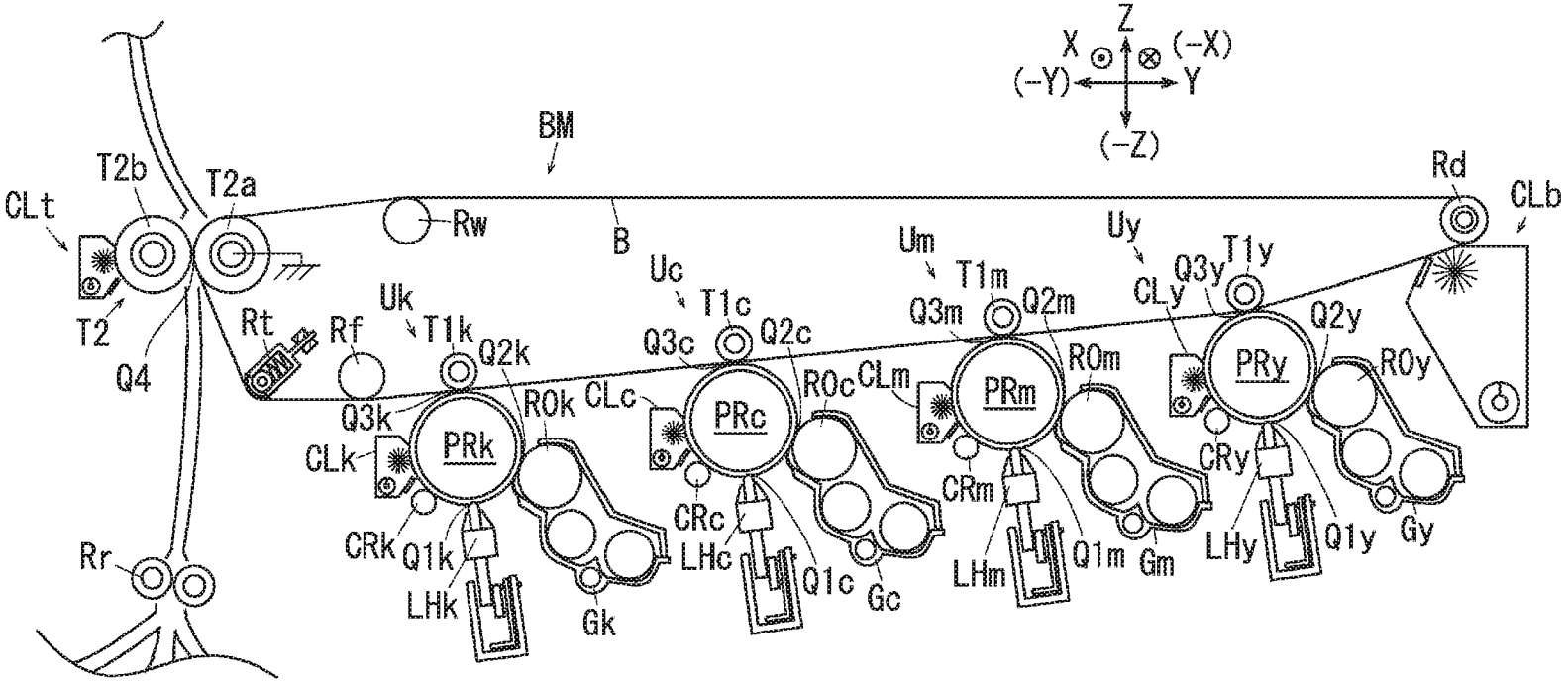
FIG. 2 illustrates a related portion of an image recording portion according to the example 1.

FIG. 2 illustrates a related portion of an image recording unit according to the example 1.

The image processor GS is electrically connected to a write circuit DL of the printer unit U1. The write circuit DL is electrically connected to exposure devices LHy, LHm, LHc, and LHk, which are an example of a latent image forming member.

The exposure devices LHy to LHk according to the example 1 are formed from, for example, LED heads each including multiple LEDs arranged in the main scanning direction. The exposure devices LHy to LHk are capable of outputting write light, corresponding to the colors Y, M, C, and K in response to signals input from the write circuit DL.

The write circuit DL or a power circuit E has write timing or power feed timing controlled in accordance with control signals from a controller C, which is an example of a controller.

In FIG. 1, photoconductors PRy, PRm, PRc, and PRk, which are an example of an image carrier, are disposed above the exposure devices LHy to LHk. In FIGS. 1 and 2, the areas of the photoconductors PRy to PRk respectively irradiated with the write light constitute write areas Q1*y*, Q1*m*, Q1*c*, and Q1*k*.

Upstream of the write areas Q1*y* to Q1*k* in the rotation direction of the photoconductors PRy, PRm, PRc, and PRk, charging rollers CRy, CRm, CRc, and CRk, which are an example of a charging member, are disposed. The charging rollers CRy to CRk according to the example 1 are supported to be driven to rotate in contact with the photoconductors PRy to PRk.

Downstream of the write areas Q1*y* to Q1*k* in the rotation direction of the photoconductors PRy to PRk, developing devices Gy, Gm, Gc, and Gk, which are an example of a developing member, are disposed. The areas over which the photoconductors PRy to PRk and the developing devices Gy to Gk face each other constitute development areas Q2*y*, Q2*m*, Q2*c*, and Q2*k*.

Downstream of the developing devices Gy to Gk in the rotation direction of the photoconductors PRy to PRk, first transfer rollers T1*y*, T1*m*, T1*c*, and T1*k*, which are an example of a first transfer member, are disposed. The areas over which the photoconductors PRy to PRk and the first transfer rollers T1*y* to T1*k* face each other constitute first transfer areas Q3*y*, Q3*m*, Q3*c*, and Q3*k*.

Downstream of the first transfer rollers T1*y* to T1*k* in the rotation direction of the photoconductors PRy to PRk, photoconductor cleaners CLy, CLm, CLc, and CLk, which are an example of a cleaner, are disposed.

The photoconductor PRy, the charging roller CRy, the exposure device LHy, the developing device Gy, the first transfer roller T1*y*, and the photoconductor cleaner CLy for the color Y constitute an image forming unit Uy for the color Y, which is an example of a visible image forming member for the color Y according to the example 1 that forms toner images for the color Y. Similarly, the photoconductors PRm, PRc, and PRk, the charging rollers CRm, CRc, and CRk, the exposure devices LHm, LHc, and LHk, the developing devices Gm, Gc, and Gk, the first transfer rollers T1*m*, T1*c*, and T1*k*, and the photoconductor cleaners CLm, CLc, and CLk constitute image forming units Um, Uc, and Uk for the colors M, C, and K.

Above the photoconductors PRy to PRk, a belt module BM, which is an example of an intermediate transfer device, is disposed. The belt module BM is an example of an image carrier, and includes an intermediate transfer belt B, which is an example of an intermediate transfer member. The intermediate transfer belt B is formed from an endless belt member.

The intermediate transfer belt B according to the example 1 is rotatably supported by a tension roller Rt, which is an example of a tension member, a walking roller Rw, which is an example of an imbalance correcting member, an idler roller Rf, which is an example of a driven member, a backup roller T2*a*, which is an example of a member opposing the second transfer area, the first transfer rollers T1*y*, T1*m*, T1*c*, and T1*k*, and a driving roller Rd, which is an example of a driving member. In the example 1, the intermediate transfer belt B rotates when the driving roller Rd receives a driving force.

At the position opposing the backup roller T2*a* across the intermediate transfer belt B, a second transfer roller T2*b*, which is an example of a second transfer member, is disposed. The backup roller T2*a*, the second transfer roller T2*b*, and other components constitute a second transfer device T2 according to the example 1, which is an example of a transfer device. The area over which the second transfer roller T2*b* and the intermediate transfer belt B come into contact with each other forms a second transfer area Q4.

Downstream of the second transfer area Q4 in the rotation direction of the intermediate transfer belt B, a belt cleaner CLb, which is an example of a device for cleaning an intermediate transfer body, is disposed.

The first transfer rollers T1*y* to T1*k*, the intermediate transfer belt B, the second transfer device T2, and other components constitute a transfer device T1+T2+B according to the example 1, which is an example of a transfer member. The image forming units Uy to Uk and the transfer device T1+T2+B constitute an image recording unit Uy+Um+Uc+Uk+T1+T2+B according to the example 1.

In FIG. 1, below the image forming units Uy to Uk, four pairs of left and right guide rails GR, which are an example of a guide member, are disposed on four levels. Each pair of guide rails GR supports a corresponding one of sheet feed trays TR1 to TR4, which are an example of a medium accommodating member, while allowing the sheet feed tray to be inserted thereinto or removed therefrom in the front-rear direction. The sheet feed trays TR1 to TR4 accommodate recording sheets S, which are an example of a medium.

On the upper left of each of the sheet feed trays TR1 to TR4, a pickup roller Rp, which is an example of a pickup member, is disposed. Downstream of each pickup roller Rp in the direction in which the recording sheets S are transported, separation rollers Rs, which are an example of a separation member, are disposed. Downstream of the separation rollers Rs in the direction in which the recording sheets S are transported, a sheet feed path SH1, which is an example of a medium transport path, extends upward. On the sheet feed path SH1, multiple transport rollers Ra, which are an example of a transport member, are disposed.

On the lower left of the copying machine U, a manual tray TR0, which is an example of a medium accommodating member, is disposed. On the upper right of the manual tray TR0, pickup rollers Rp0 are disposed, and a manual feed path SH0 extends from the pickup rollers Rp0. The manual feed path SH0 is merged with the sheet feed path SH1.

Registration rollers Rr, which are an example of a transport timing adjusting member, are disposed on the sheet feed path SH1 upstream of the second transfer area Q4. A transport path SH2 extends from the registration rollers Rr to the second transfer area Q4.

Downstream of the second transfer area Q4 in the direction in which the recording sheets S are transported, a fixing device F, which is an example of a fixing member, is disposed. The fixing device F includes a heating roller Fh, which is an example of a heating fixing member, and a pressing roller Fp, which is an example of a pressing fixing member. The area over which the heating roller Fh and the pressing roller Fp come into contact with each other constitutes a fixing area Q5.

On the upper surface of the printer unit U1, a lower paper output tray TRh, which is an example of a medium output portion, is disposed. A paper output path SH3, which is an example of a medium transport member, extends toward the lower paper output tray TRh above the fixing device F. At the downstream end of the paper output path SH3, output rollers Rh, which are an example of a medium transport member, are disposed.

Above the lower paper output tray TRh, an upper paper output tray TRh2, which is an example of a medium output portion, is disposed. Above the fixing device F, an upper transport path SH4, which diverges from the paper output path SH3, extends toward the upper paper output tray TRh2.

On the upper transport path SH4, reversing rollers Rb rotatable forward and rearward, which are an example of a medium transport member, are disposed. Above the point of divergence between the paper output path SH3 and the upper transport path SH4, a reverse path SH6, which is an example of a medium transport path, diverges downward to the left from the upper transport path SH4.

A gate GT1, which is an example of a switching member, is disposed across the point of divergence between the paper output path SH3 and the upper transport path SH4 and the point of divergence between the upper transport path SH4 and the reverse path SH6. The gate GT1 is supported to be switchable between a first guide position (second position), at which it guides a recording sheet S from the fixing device F toward the lower paper output tray TRh and guides a recording sheet S from the upper transport path SH4 to the reverse path SH6, and a second guide position (first position), at which it guides a recording sheet S from the fixing device F to the upper transport path SH4.

On the reverse path SH6, multiple transport rollers Ra, which are an example of a medium transport member, are disposed. The reverse path SH6 has its downstream end merged to the sheet feed path SH1 at a portion upstream of the registration rollers Rr.

Description of Image Forming Operation

When an operator manually places a document Gi on the platen glass PG of the copying machine U according to the example 1 having the above structure for photocopying, the reading unit U2*a* moves in the lateral direction from the initial position to scan the document Gi on the platen glass PG while exposing the document Gi to light. When the auto-feeder U3 is used to automatically transport the documents Gi for photocopying, the reading unit U2*a* moves from the initial position to a document read position on the left and remains stationary. Thereafter, the multiple documents Gi accommodated in the document tray TG1 are sequentially transported to the document read position on the platen glass PG, and then passes the document read position to be discharged onto the document output tray TG2. The documents Gi that sequentially pass the read position on the platen glass PG are exposed to light and scanned by the stationary reading unit U2*a*. Light reflected off the documents Gi is received by the reading unit U2*a*. The reading unit U2*a* converts the received light reflected off the documents Gi into electric signals.

The image processor GS receives electric signals output from the reading unit U2*a*. The image processor GS converts the electric signals of images of the colors R, G, and B read by the reading unit U2*a* into image information of yellow Y, magenta M, cyan C, and black K for latent image formation. The image processor GS outputs the converted image information to the write circuit DL of the printer unit U1. The image processor GS outputs the image information for only black K to the write circuit DL when an image is a single-color image, or a monochrome image.

The write circuit DL outputs control signals corresponding to the input image information to the exposure devices LHy to LHk. The exposure devices LHy to LHk output the write light corresponding to the control signals.

The photoconductors PRy to PRk rotate in response to the start of image formation. The charging rollers CRy to CRk receive a charging voltage from the power circuit E. Thus, the photoconductors PRy to PRk have their surfaces electrically charged by the charging rollers CRy to CRk. Electrostatic latent images are formed in the write areas Q1*y* to Q1*k* on the surfaces of the electrically charged photoconductors PRy to PRk with the laser beams Ly to Lk. The electrostatic latent images on the photoconductors PRy to PRk are developed into toner images, which are an example of a visible image, by the developing devices Gy, Gm, Gc, and Gk in the development areas Q2*y* to Q2*k*.

The developed toner images are transported to the first transfer areas Q3*y*, Q3*m*, Q3*c*, and Q3*k*, at which they come into contact with the intermediate transfer belt B, which is an example of an intermediate transfer body. In the first transfer areas Q3*y*, Q3*m*, Q3*c*, and Q3*k*, the first transfer rollers T1*y* to T1*k* receive, from the power circuit E, a first transfer voltage having a polarity opposite to the polarity with which the toner is charged. Thus, the toner images on the photoconductors PRy to PRk are transferred to the intermediate transfer belt B by the first transfer rollers T1*y* to T1*k*. To form a multi-color toner image, a toner image on the downstream side is transferred to the intermediate transfer belt B to be superposed on a toner image that has been transferred to the intermediate transfer belt B in the upstream first transfer area.

Remnants or deposits left on the photoconductors PRy to PRk after a first transfer are respectively removed by the photoconductor cleaners CLy to CLk. The surfaces of the cleaned photoconductors PRy to PRk are respectively electrically recharged by the charging rollers CRy to CRk.

Single-color or multi-color toner images transferred onto the intermediate transfer belt B by the first transfer rollers T1*y* to T1*k* in the first transfer areas Q3*y* to Q3*k* are transported to the second transfer area Q4.

Recording sheets S on which images are to be recorded are picked up by the pickup roller Rp of an appropriate one of the sheet feed trays TR1 to TR4. The recording sheets S picked up by the pickup roller Rp while being stacked together are separated one from another by the separation rollers Rs. The recording sheets S separated by the separation rollers Rs are transported along the sheet feed path SH1 by the transport rollers Ra. The recording sheets S transported along the sheet feed path SH1 are fed to the registration rollers Rr. The recording sheets S placed on the manual tray TR0 are also fed to the sheet feed path SH1 through the manual feed path SH0 by the pickup rollers Rp0.

The registration rollers Rr transport a recording sheet S to the second transfer area Q4 at the timing when a toner image formed on the intermediate transfer belt B is transported to the second transfer area Q4. The second transfer roller T2*b* receives, from the power circuit E, a second transfer voltage having a polarity opposite to the polarity with which toner is charged. Thus, the toner image on the intermediate transfer belt B is transferred to the recording sheet S from the intermediate transfer belt B.

After the second transfer, the intermediate transfer belt B is cleaned by the belt cleaner CLb to remove deposits or other matters adhering to the surface.

The recording sheet S to which the toner image has been second-transferred is heated to have the toner image fixed while passing the fixing area Q5.

When the recording sheet S having an image fixed thereto is discharged to the lower paper output tray TRh, the gate GT1 is moved to the first guide position. The recording sheet S discharged from the fixing device F is thus transported along the paper output path SH3. The recording sheet S transported along the paper output path SH3 is discharged to the lower paper output tray TRh by the output rollers Rh.

When the recording sheet S is to be discharged to the upper paper output tray TRh2, the gate GT1 is moved to the second guide position to allow the recording sheet S to be discharged to the upper paper output tray TRh2.

When the recording sheet S is to be subjected to double-side printing, the gate GT1 is moved to the second guide position. When the recording sheet S has its trailing end passing the gate GT1, the gate GT1 is moved to the first guide position, and the reversing rollers Rb rotate rearward. Thus, the recording sheet S is guided to the gate GT1, and transported to the reverse path SH6.

Description of Developer Recovery System

Figure 3:
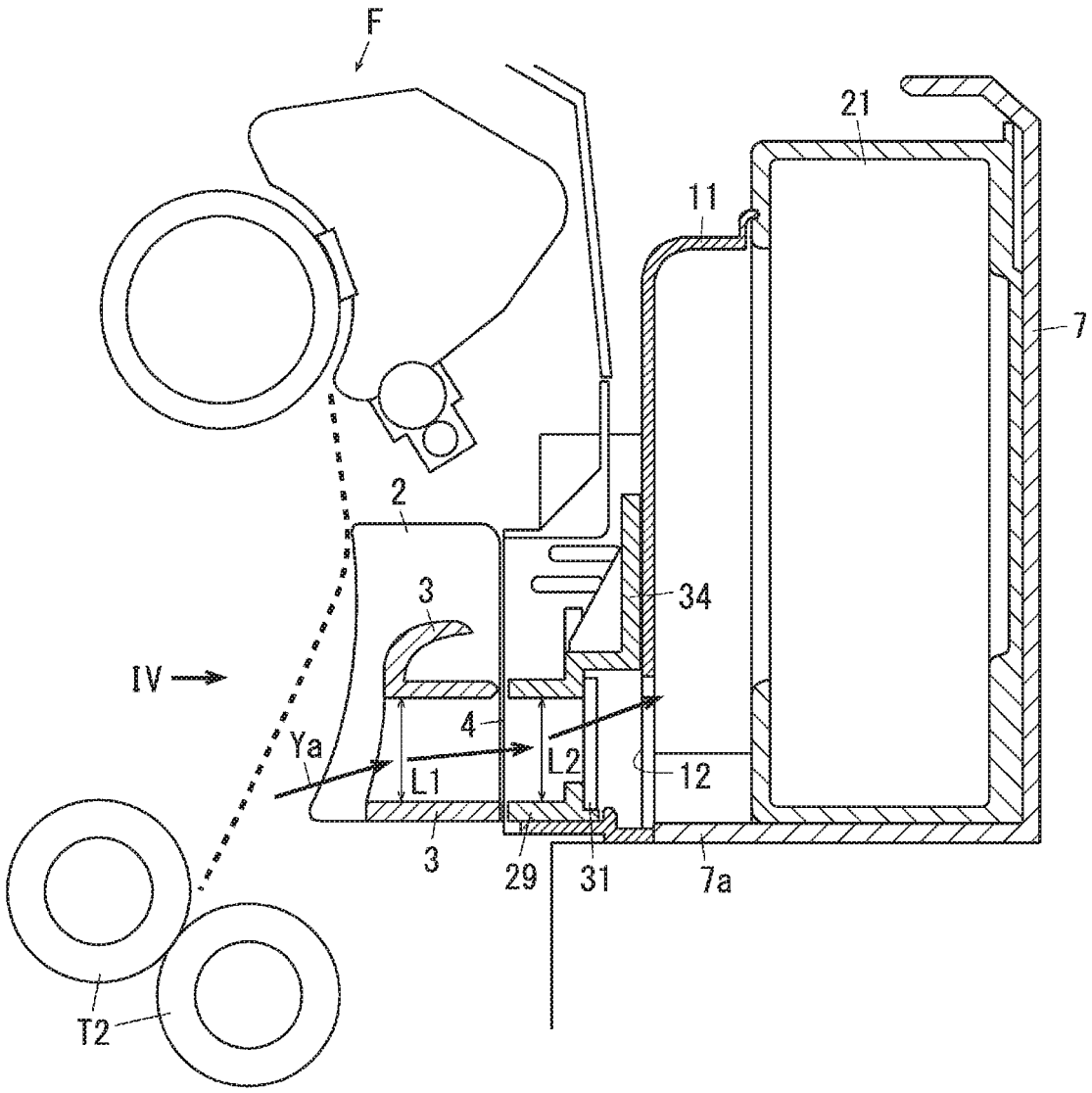
FIG. 3 is a cross-sectional view of a related portion of a developer recovery system according to the example 1.

FIG. 3 is a cross-sectional view of a related portion of a developer recovery system according to the example 1.

Figure 4:
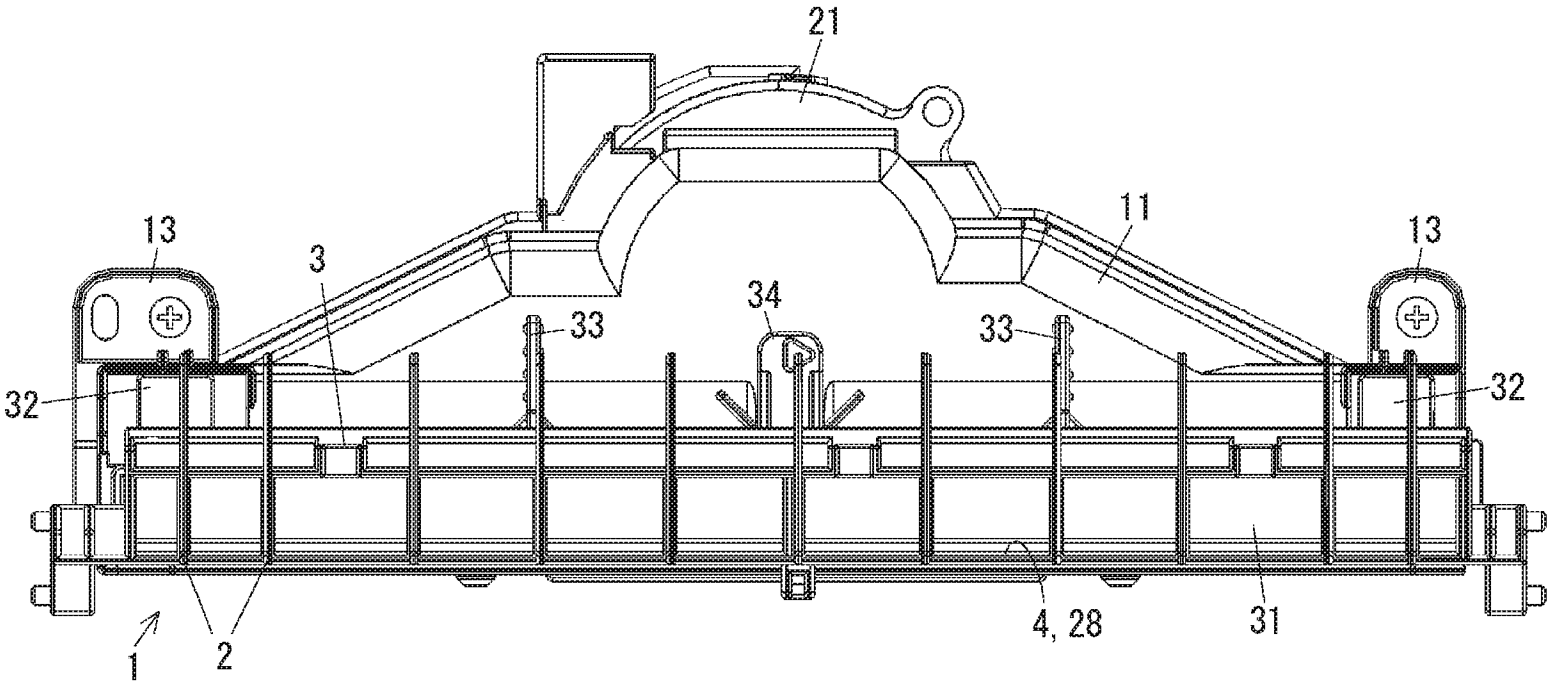
FIG. 4 is a view of the portion viewed in a direction of arrow IV in FIG. 3.

FIG. 4 is a view of the portion viewed in a direction of arrow IV in FIG. 3.

Figure 5:
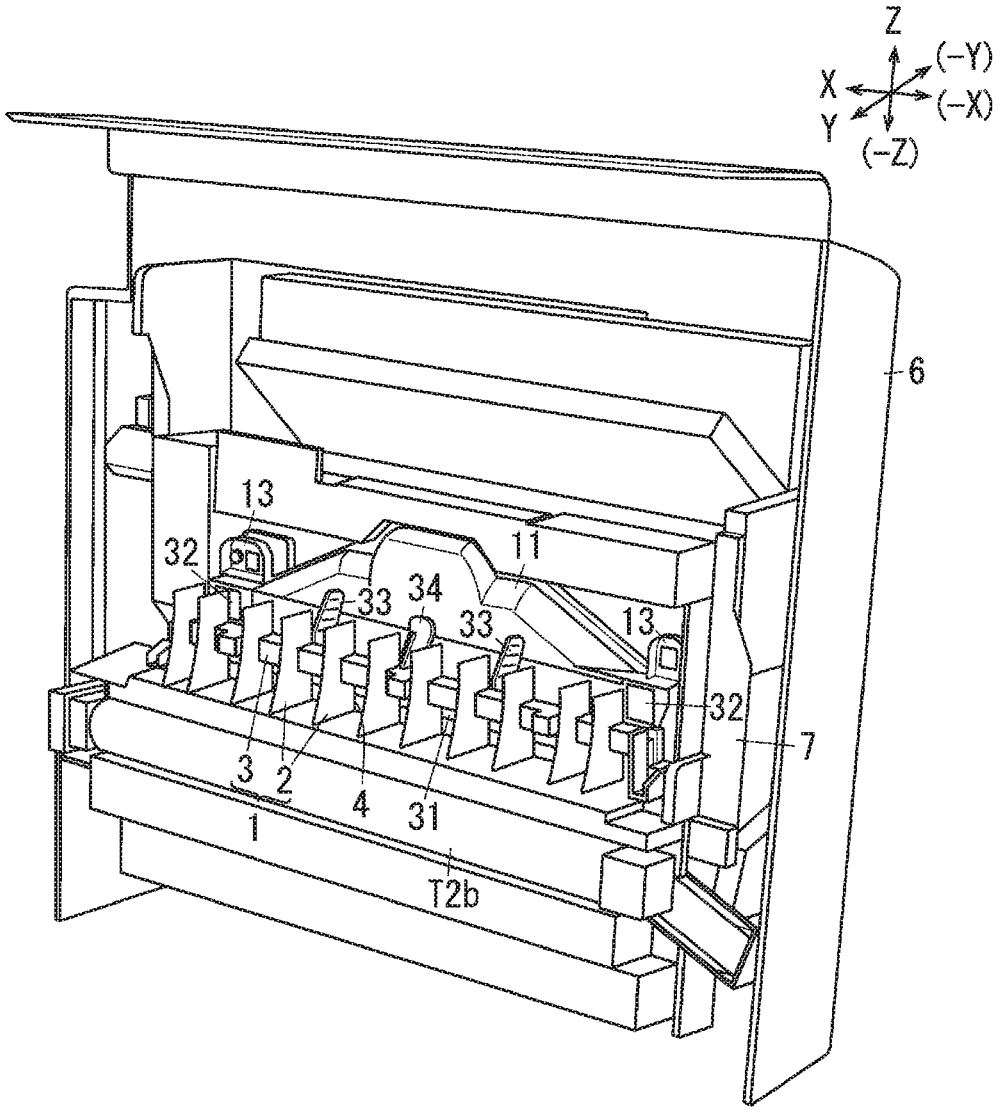
FIG. 5 illustrates an inside of an open/close cover according to the example 1.

FIG. 5 illustrates an inside of an open/close cover according to the example 1.

In FIGS. 3 to 5, a seat guide 1, which is an example of a guide member, is disposed between the second transfer device T2, which is an example of a transfer member, and the fixing device F, which is an example of a transfer member. The seat guide 1 according to the example 1 includes guide bodies 2, which are an example of a body of a guide member. The guide bodies 2 are spaced apart from each other in the width direction (X direction) of the recording sheet S. The guide bodies 2 are coupled together with a coupling portion 3, which extends in the width direction of the recording sheet S. In FIG. 3 and FIG. 4, the coupling portion 3 has an opening 4 on an upstream side of the seat guide 1 in a transport direction of the recording sheet S. As illustrated in FIG. 3 and FIG. 4, the opening 4 is disposed closer to the second transfer device T2 than the middle between the second transfer device T2 and the fixing device F.

In FIG. 3, the coupling portion 3 extends leftward from above and below the opening 4, and constitutes an attraction prevention member according to the example 1. Thus, the coupling portion 3 serving as an attraction prevention member is disposed upstream of the opening 4 (closer to the second transfer device T2) in a developer attraction direction Ya, and has a width the same as a width L1 of the opening 4 in the direction in which the recording sheet S is transported.

In FIG. 5, the seat guide 1 is supported by an open/close cover 6, which is an example of an open-close member. The open/close cover 6 is supported to be rotatable about a rotation axis at the lower end between an open position, in which it renders the inside of the body of the copying machine U open, and a closed position, in which it renders the inside of the body of the copying machine U closed. When moved to the open position, the open/close cover 6 renders a transport path of recording sheets S open to allow a jammed recording sheet S to be removed.

Inside the open/close cover 6, a cover frame 7, which is an example of a frame, is supported.

Figure 6:
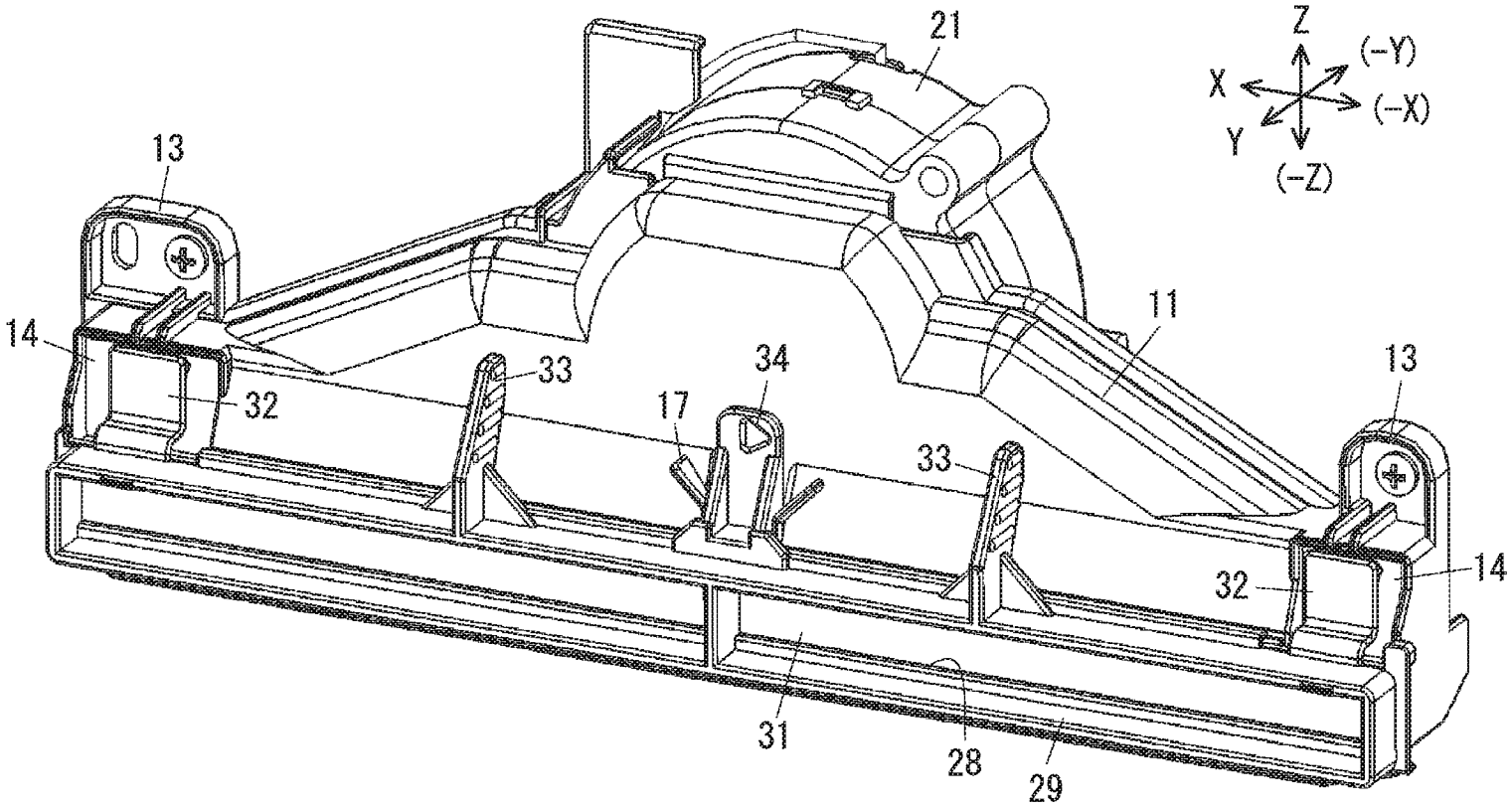
FIG. 6 illustrates a fan, a duct, and a filter according to the example 1.

FIG. 6 illustrates a fan, a duct, and a filter according to the example 1.

Figure 7:
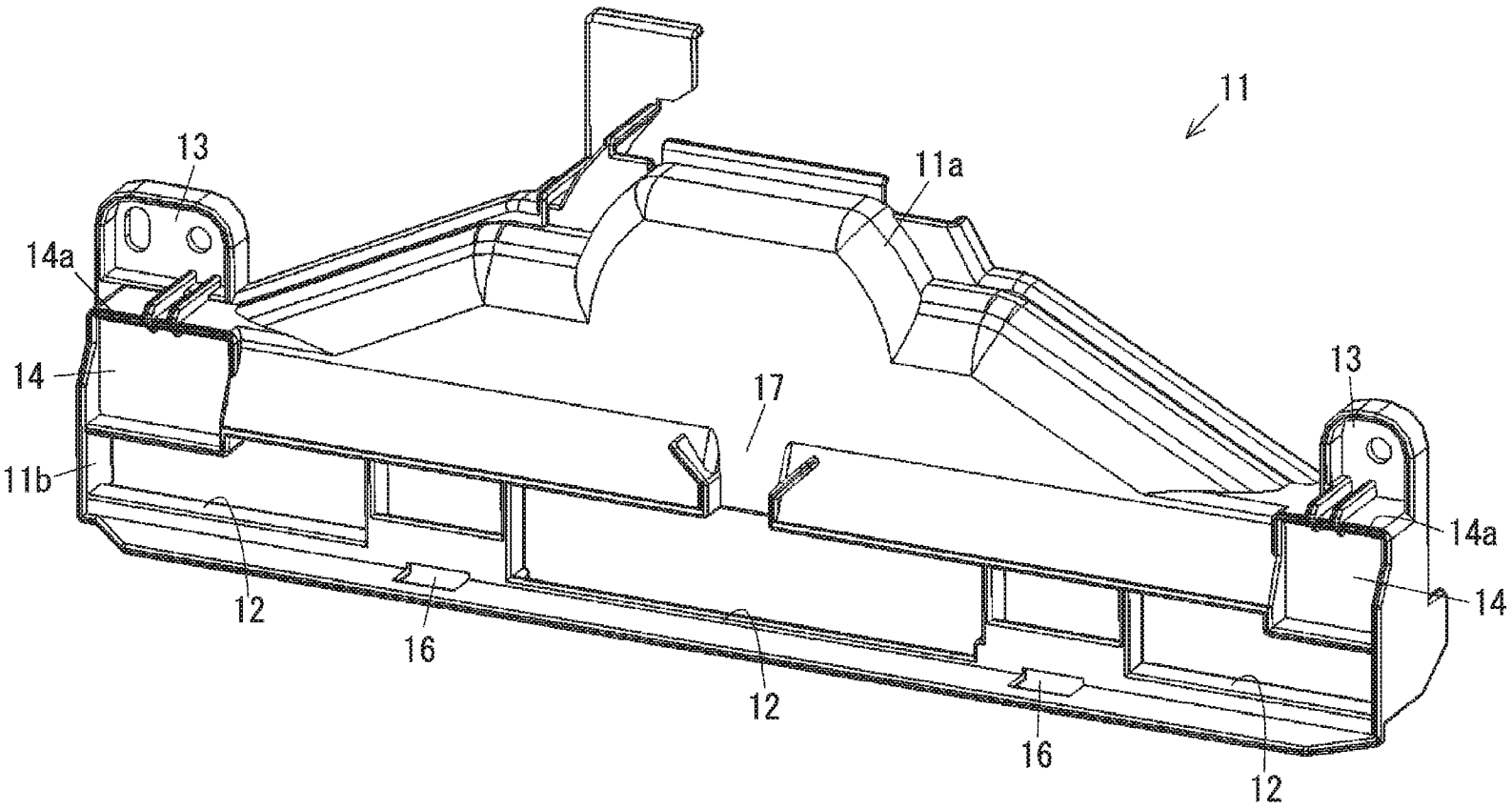
FIG. 7 illustrates the duct according to the example 1.

FIG. 7 illustrates the duct according to the example 1.

In FIG. 5 to FIG. 7, the cover frame 7 supports a duct 11, which is an example of a flow-path forming member. The duct 11 has an upper portion 11*a* that is inclined further inward in the width direction of the recording sheet S as it extends upward. The duct 11 has a lower portion 11*b* that has inlet ports 12. Each inlet port 12 is disposed on the right side of the opening 4 of the seat guide 1. In FIG. 3, a space defined by the right side of the duct 11 and a frame duct portion 7*a* of the cover frame 7, which serves as a flow-path forming portion, forms a path that allows gas transfer.

At both end portions of the duct 11 in the width direction, fastened portions 13 extend upward. The duct 11 is screwed on the cover frame 7 with the fastened portions 13 interposed therebetween. Specifically, the duct 11 is fastened to the copying machine U with the open/close cover 6 interposed therebetween. Recesses 14 are disposed below the fastened portions 13. Each recess 14 has a stair 14*a* at the upper edge.

A pair of filter positioning holes 16, which are an example of a positioning member, are formed at a lower end portion of the duct 11. A vertically extending filter positioning groove 17, which is an example of a positioning member, is formed at a middle in the vertical direction and the width direction of the duct 11.

In FIG. 3 and FIG. 6, a fan 21, which is an example of an attraction member, is disposed on the right side of the duct 11. In operation, the fan 21 is capable of attracting, together with gas, a developer near the second transfer device T2 through the opening 4. In FIG. 3, the fan 21 is supported by the open/close cover 6 by being held between the duct 11 and the cover frame 7. Thus, in the example 1, the fan 21 is not fixed with a screw or other devices, and is easily removable through removal of the duct 11.

Figure 8:
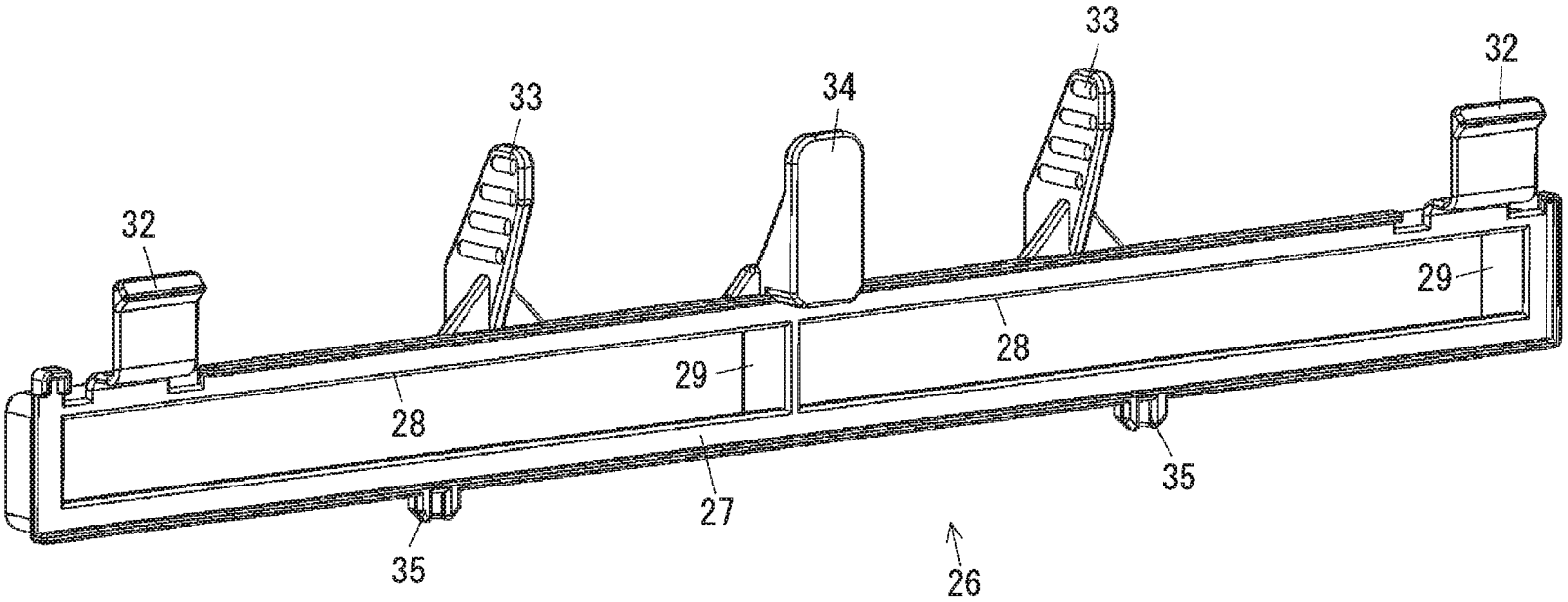
FIG. 8 is a perspective view of the filter according to the example 1 viewed from the downstream side in an attraction direction.

FIG. 8 is a perspective view of a filter according to the example 1 viewed from the downstream side in the attraction direction.

In FIG. 3, FIG. 6, and FIG. 8, a filter unit 26, which is an example of an elimination member, is disposed between the seat guide 1 and the duct 11. The filter unit 26 includes a filter frame 27, which is an example of a frame of the elimination member. The filter frame 27 has a thin, long shape extending in the width direction of the recording sheet S. Filter openings 28, extending in the width direction, are formed in the filter frame 27. The filter frame 27 has edge portions 29, which extend into the opening 4 to surround the filter openings 28. In FIG. 3, the up-down dimension L2 of the edge portion 29 corresponds to the width L1 of the opening 4.

A filter body 31, which is an example of a body of an elimination member, is attached to and supported on the right surface of the filter openings 28 of the filter frame 27. Examples usable as the filter body 31 include any objects known thus far that capture and remove a developer and allow gas to pass therethrough. Depending on the particle diameter or charging characteristics of a developer, a material such as a nonwoven fabric or polyurethane sponge is preferably usable.

At both end portions, in the width direction, of the upper portion of the filter frame 27, lock hooks 32 extend upward to serve as an example of a fastening portion. When the filter unit 26 is attached to the open/close cover 6, the lock hooks 32 are fitted into the recesses 14. In this state, the lock hooks 32 are less likely to cross over the stairs 14*a* toward the fastened portions 13. Thus, the filter unit 26 is held while being attached to the duct 11.

On the inner sides of the lock hooks 32 in the width direction, handles 33, which are an example of an operation portion, are disposed. The handles 33 are portions that an operator picks up and operates to remove the filter unit 26 from the duct 11. When the operator picks up and brings the handles 33 upward (toward the fixing device F), the lock hooks 32 are elastically deformed to cross over the stairs 14*a*, and the filter unit 26 is allowed to be removed.

On the inner sides of the handles 33, an upper positioning rib 34, which is an example of a to-be-positioned member, is disposed. In FIG. 8, at the lower portion of the filter frame 27, a pair of lower positioning projections 35, which are an example of a to-be-positioned member, extend downward. When the filter unit 26 is attached to the duct 11, the upper positioning rib 34 comes into contact with a filter positioning groove 17, and the lower positioning projections 35 come into contact with and penetrate through filter positioning holes 16, so that the filter unit 26 is attached to the duct 11 while being fixed at a predetermined position.

In the example 1, when the open/close cover 6 is in the open position, the seat guide 1 is positioned on the upper side and the duct 11 is positioned on the lower side in the direction of gravity. Thus, the upstream surface of the filter body 31 faces upward in the direction of gravity. To remove the filter unit 26 from the duct 11 by operating the handles 33, the filter unit 26 is removed by being pulled out in a substantially horizontal direction.

Components denoted with the reference signs 1 to 35 constitute a developer recovery system according to the example 1.

Effects According to Example 1

In the copying machine U according to the example 1 having the above structure, the fan 21 operates during image forming operation. The copying machine U is thus capable of attracting and removing a floating developer near the second transfer device T2.

Near the second transfer device T2, the alternating voltage applied during transfer causes a developer to vibrate between the recording sheet S and the intermediate transfer belt B, so that the developer may float.

Particularly, during printing of an image with no margin, an image larger than the size of the recording sheet S is formed. The portion of the image on the outer side of the outer edge of the recording sheet S fails to be transferred to the recording sheet S and is thus more likely to float. In addition, during transportation of the recording sheet S, the developer may float with vibrations caused when the front end comes into contact with the seat guide 1. In the structure not including an attraction mechanism, the inside of the copying machine U becomes stained with a floating developer, which also causes a recording sheet S subsequently transported to become stained. In the technologies described in U.S. Pat. No. 9,746,803 (FIG. 2), Japanese Patent Application Publication No. 2017-120284 (FIG. 1), and Japanese Patent Application Publication No. 2017-125976 (FIG. 4 and FIG. 5), minute particles that have volatilized with heat during fixing are to be attracted, and have a smaller particle diameter than the developer. Thus, these technologies are for a structure that attracts gas near a fixing device that causes minute particles, and thus include a filter different from the one that removes a developer. The example 1, on the other hand, attracts a developer that floats near the second transfer device T2 through the opening 4 formed upstream of the seat guide 1. The inside of the copying machine U according to the example 1 is thus less likely to become stained with a developer.

In the example 1, the opening 4 is disposed upstream of the middle between the second transfer device T2 and the fixing device F. This structure is thus less likely to attract gas from the side near the fixing device F. This structure is thus prevented from attracting a floating object caused near the fixing device F (from the downstream side of the seat guide 1). The life of the filter body 31 is thus extended further than the structure that attracts a floating object near the fixing device F.

The coupling portion 3 extends to the side upstream of the opening 4 in a gas-attraction direction Ya. The coupling portion 3 is thus less likely to attract a floating object from the side near the fixing device F (downstream of the seat guide 1). Thus, the life of the filter body 31 is extended.

The filter body 31 is removably attached, and thus is replaceable with another when becomes stained. To replace the filter body 31 with another, the open/close cover 6 is moved to the open position to replace the filter unit 26 with another. In the open position, the upstream surface of the filter body 31 faces upward. When the upstream surface of the filter body 31 faces downward in the open position, the developer adhering to the filter body 31 may fall from the filter body 31, so that the inside of the copying machine U may become stained. On the other hand, in the example 1, the upstream surface of the filter body 31 faces upward in the open position, so that the developer is less likely to fall from the filter body 31, and the inside of the copying machine U is less likely to become stained.

To replace the filter unit 26 with another, the filter unit 26 is pulled out for replacement in the horizontal direction while the upstream surface of the filter body 31 faces upward. This structure makes it less likely during a replacement operation that the developer falls from the filter body 31 to cause the copying machine U or operator's hands or clothes to become stained.

The filter unit 26 has its position fixed by the upper positioning rib 34 and the filter positioning groove 17, and the lower positioning projections 35 and the filter positioning holes 16. Thus, the filter body 31 is allowed to be securely attached to a predetermined position. This structure is less likely to cause misalignment of the filter body 31, and thus less likely to allow the developer to be discharged without passing through the filter body 31.

In the example 1, the fan 21 is fixed while being held between the duct 11 and the cover frame 7. Screws or other members, if used to fix the fan 21, would increase the number of components and involve attachment processing. The example 1 does not have such problems.

Modification Example

Thus far, the examples of the present disclosure have been descried in detail. However, the disclosure is not limited to the above-described examples, and may be modified in various manners within the scope of the gist of the present disclosure described in the scope of claims. Modified examples H01 to H05 of the present disclosure are described, below, by way of examples.

H01

In the above examples, the copying machine U has been described as an example of an image forming apparatus. The present disclosure is not limited to this, however. The image forming apparatus is applicable to a FAX machine, or a multifunctional printer having multiple functions such as a FAX machine, a printer, and a copying machine. The image forming apparatus is not limited to an electrophotographic image forming apparatus, and is applicable to an image forming apparatus of any image forming form such as ink jet printing, or photolithographic printing including thermal head printing. In addition, the image forming apparatus is not limited to an image forming apparatus for multi-color development, and may be an image forming apparatus for forming single-color or monochrome images.

H02

In the example, the filter unit 26 is preferably removably attached, but may be unremovable. When the open/close cover 6 is in the open position, the upstream surface of the filter body 31 preferably faces upward, but may face downward.

H03

In the above examples, the components for positioning the filter unit 26 are not limited to the ones illustrated by way of examples. The number, positions, shapes, or other details are changeable in accordance with the design or specifications.

H04

In the above examples, the coupling portion 3 that is illustrated by way of example extends leftward, but is not limited to this. For example, the coupling portion 3 may obliquely extend toward the second transfer device T2, or may be formed not to have a shape extending from the opening 4.

H05

In the example, the fan 21 is desirably fixed without screws and the like, but may be fixed with screws and the like.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus, comprising:

a transfer member that transfers a developer to a medium;

a fixing member that fixes onto the medium the developer transferred to the medium;

a guide member that is disposed between the transfer member and the fixing member to contact and guide the medium, the guide member being a stationary member;

an attraction member that attracts the developer through an opening;

an elimination member that allows gas to pass therethrough while removing the developer attracted through the opening, the elimination member being removable from and attachable to a body of the image forming apparatus; and an open-close member that is supported to be openable and closeable between an open position, in which the open-close member renders an inside of the image forming apparatus open, and a closed position, in which the open-close member renders the inside of the image forming apparatus closed, the open-close member supporting the elimination member, the open-close member allowing, when in the open position, an upstream surface of the elimination member in a direction in which the developer is attracted to face upward with respect to a direction of gravity, wherein the opening is located upstream of the guide member in a medium transport direction, on a same side of the medium as the guide member, and is stationary with respect to a transfer location where the transfer member transfers the image to the medium, wherein the opening is located in an upstream half of a path between the transfer member and the fixing member.

2. The image forming apparatus according to claim 1, further comprising:

a positioning member disposed on the body of the image forming apparatus; and a to-be-positioned member disposed on the elimination member, the to-be-positioned member coming into contact with and being fixed to the positioning member when the elimination member is attached to the body of the image forming apparatus.

3. The image forming apparatus according to claim 1, wherein the elimination member is attached to and removed from the body of the image forming apparatus by moving toward and away from the open-close member while the upstream surface of the elimination member faces upward.

4. The image forming apparatus according to claim 1, further comprising:

a flow-path forming member that is disposed upstream of the attraction member in a direction in which the developer is attracted to form a path through which gas is transported, the flow-path forming member being fixed to and supported by a body of the image forming apparatus, wherein the attraction member is supported by the body of the image forming apparatus by being held between the flow-path forming member and a frame of the image forming apparatus.

* * * * *